US006474697B2

(12) United States Patent
Nording et al.

(10) Patent No.: US 6,474,697 B2
(45) Date of Patent: Nov. 5, 2002

(54) EXHAUST ELBOW

(75) Inventors: Thomas Nording, Esslingen (DE); Thomas Hauber, Altbach (DE); Tassilo Adam, Zweibrücken (DE); Uwe Gräss, Ottweiler (DE)

(73) Assignee: J. Eberspächer GmbH & Co. KG (DE)

( * ) Notice: Subject to any disclaimer, the term of this patent is extended or adjusted under 35 U.S.C. 154(b) by 0 days.

(21) Appl. No.: 09/905,239

(22) Filed: Jul. 13, 2001

(65) Prior Publication Data

US 2002/0017786 A1 Feb. 14, 2002

(30) Foreign Application Priority Data

Jul. 15, 2000 (DE) ..... 100 34 538

(51) Int. Cl.[7] ..... F01N 7/10

(52) U.S. Cl. ..... 285/179; 285/183; 285/424; 60/323; 60/305; 29/890.052

(58) Field of Search ..... 60/323, 305; 285/179, 285/183, 424, 179.2; 29/890.032

(56) References Cited

U.S. PATENT DOCUMENTS 1,327,311 A * 1/1920 Chesnutt ..... 60/323
2,713,195 A * 7/1955 Hemmer ..... 60/323
3,522,702 A * 8/1970 Grosseau ..... 60/305
4,132,285 A * 1/1979 Milde et al. ..... 181/258
4,372,112 A * 2/1983 Ackerman et al. ..... 60/323
4,373,331 A * 2/1983 Santiago et al. ..... 60/323
4,386,586 A * 6/1983 Santiago et al. ..... 60/323
4,779,415 A * 10/1988 Richardson et al. ..... 60/313
5,134,852 A * 8/1992 Weeks ..... 60/323
5,327,722 A * 7/1994 Clegg et al. ..... 60/323
5,572,868 A * 11/1996 Okamoto et al. ..... 60/323
5,682,741 A * 11/1997 Augistin et al. ..... 60/323
5,768,890 A * 6/1998 Bekkering et al. ..... 60/305
5,784,882 A * 7/1998 Bonny et al. ..... 60/323
5,867,985 A * 2/1999 Furuhashi et al. ..... 60/323
5,937,642 A * 8/1999 Magarida et al. ..... 60/323
6,247,552 B1 * 6/2001 Kovar et al. ..... 60/323
6,264,880 B1 * 7/2001 Elmer et al. ..... 264/572
6,324,839 B1 * 12/2001 Canini et al. ..... 60/323

* cited by examiner

*Primary Examiner*—Eric K. Nicholson
(74) *Attorney, Agent, or Firm*—McGlew and Tuttle, P.C.

(57) ABSTRACT

An exhaust elbow (1) is provided with a single exhaust outlet (2) with an outlet mounting flange (3) and at least two exhaust inlets (4, 5, 6) with an inlet mounting flange (7) for fastening on the engine block of a motor vehicle. The exhaust guiding of the exhaust elbow (1) between the inlet mounting flange (7) and the outlet mounting flange (3) is formed by a single-walled sheet metal hood (8) forming a collection line. The sheet metal hood (8) surrounds all exhaust inlets (4, 5, 6) together, without individual pipes being formed. Such a simple sheet metal elbow can be manufactured at a low cost and with low weight and nevertheless has sufficient ability to function, is dimensionally stable and can be used in a versatile manner.

7 Claims, 2 Drawing Sheets

EXHAUST ELBOW

FIELD OF THE INVENTION

The present invention pertains to an exhaust elbow with a single exhaust outlet with an outlet mounting flange and at least two exhaust inlets with inlet mounting flanges for fastening on the engine block of a motor vehicle.

BACKGROUND OF THE INVENTION

Exhaust elbows of the above-described type are formed according to the state of the art by a collector pipe, which has inlet pipe sections depending on the number of engine cylinders to be connected and an outlet pipe section, which is connected to downstream components of the exhaust system, e.g., a catalytic converter. The collector pipe may be a one-piece deep-drawn sheet metal part or be composed of individual pipes and particularly welded together.

Collector pipes manufactured according to the half shell technique have also been known, which are connected to one another by a longitudinal rebate. The collector pipe may be designed as a single-walled or double-walled pipe, i.e., with an air gap insulation, e.g., according to DE 199 52 648.

SUMMARY AND OBJECTS OF THE INVENTION

The basic object of the present invention is to provide an exhaust elbow of the above mentioned type, which has an extremely simple design and is nevertheless able to function.

According to the invention, an exhaust elbow is provided with a single exhaust outlet with an outlet mounting flange and at least two exhaust inlets with an inlet mounting flange for fastening on the engine block of a motor vehicle. The essence of the present invention is that the exhaust gas guiding of the exhaust elbow between the inlet mounting flange and the outlet mounting flange is formed by a single-walled sheet metal hood forming wherein the sheet metal hood surrounds all exhaust inlets together.

The sheet metal hood may comprise a radial flange closed on the circumference on the side of the exhaust outlet or a radial expansion, which flange or expansion is firmly connected to the outlet mounting flange in a gastight manner preferably by welding.

The sheet metal hood may correspondingly have an enveloping radial flange surrounding all exhaust inlets on the side of the exhaust inlets or a common enveloping radial expansion, which flange or expansion is firmly connected to the inlet mounting flange in a gastight manner preferably by welding.

The sheet metal hood has, in particular, shape-stabilizing indentations and/or bulges, where the indentations are preferably located in the area between the exhaust inlets.

In an especially simple variant of the present invention, the sheet metal hood is made in one piece. It may be bent from a flat sheet metal plate as a semi-finished part around a mandrel or the like into its complex final shape.

However, the sheet metal hood may also comprise, as an alternative, two half shells made from a sheet metal, which are connected to one another by means of a congruent connection flange.

The connection flange may be a gastight sheet metal rebate bent over at least once.

The two half shells may be mirror symmetrically identical in relation to the connection plane of the connection flanges.

The inlet mounting flange and the outlet mounting flange are preferably fastening plates arranged at right angles to one another with through holes for fastening on the engine block by means of studs.

Consequently, an exhaust elbow with a single outer shell in the form of a sheet metal hood, which covers the cylinder outlet opening on mounting on the engine block of the motor vehicle without forming an individual pipe itself, is proposed according to the present invention. The sheet metal hood or outer shell is single-walled. The exhaust elbow of the type according to the present invention is a very simple sheet metal elbow and can be called a so-called "primitive elbow," which is nevertheless sufficiently functional and collects the exhaust gases of the different outlet channels at the cylinder head and passes them into a discharge pipe. Considerable weight and considerable amounts of material are saved. The manufacturing costs are low. A downstream catalytic converter shows improved response behavior because of the reduced mass of the exhaust elbow. The exhaust elbow according to the present invention is suitable for all spark ignition and diesel engines and can be used in a versatile manner. It can be manufactured in an especially cost-effective manner in a large lot. The complex final shape of the sheet metal shell can be determined experimentally with respect to a favorable flow behavior, for minimizing noise, high dimensional stability and sufficient thermal loadability on a given engine unit with a certain output. Even though the sheet metal shell bent or shaped into the final shape does not have a particularly high dimensional stability in itself, the dimensional stability is obtained when the sheet metal shell is firmly welded or otherwise connected to the additionally stabilizing end flanges, e.g., by bonding or Tox clinching. A longitudinal rebate in the case of two-part half shells as a sheet metal shell leads to a further increase in the dimensional stability, as do reinforcing ribs, indentations, bulges and the like, especially the bent-up welded edges in the area of the end flanges.

The present invention will be explained in greater detail below on the basis of an exemplary embodiment with reference to the drawing attached.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
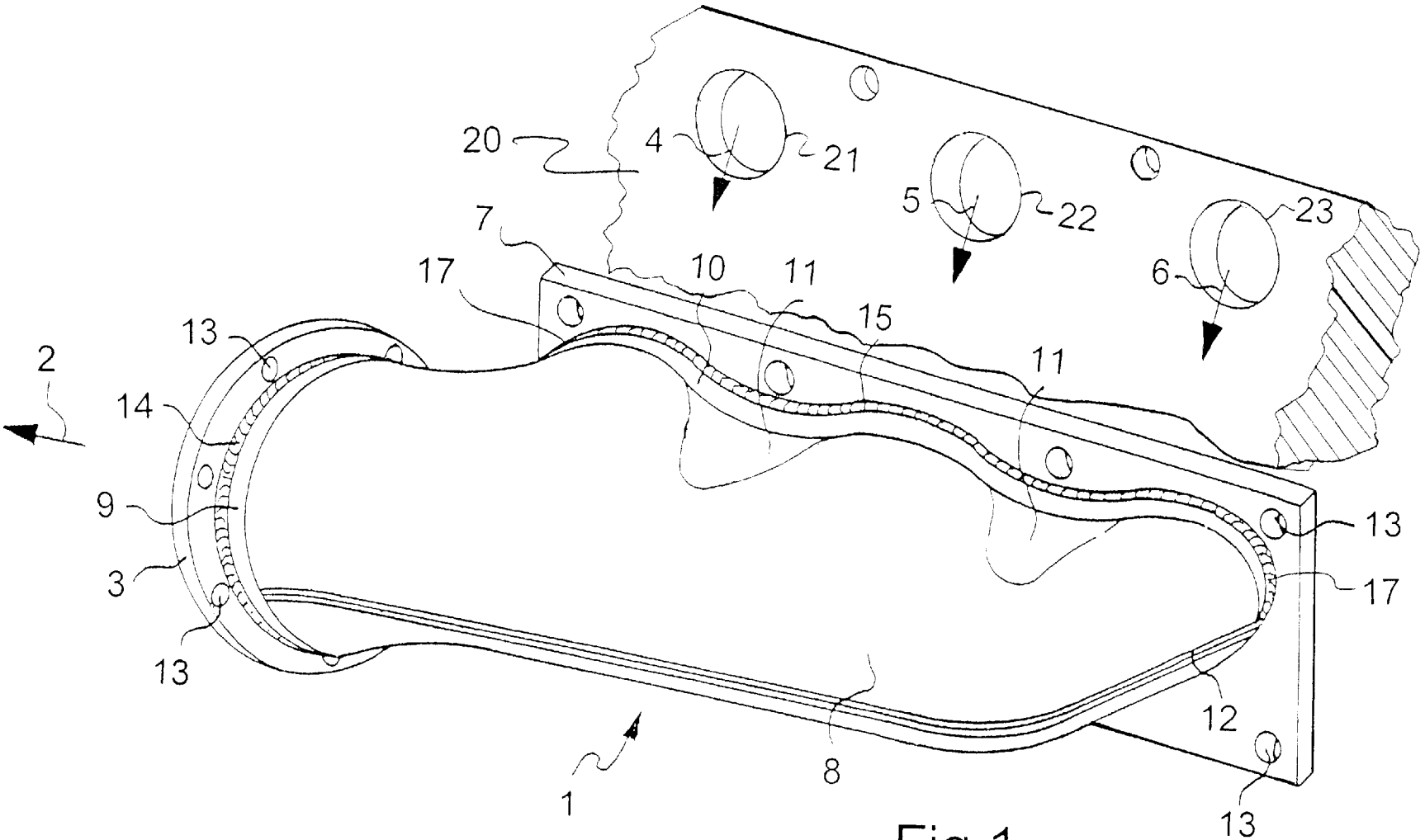
FIG. 1 is a schematic perspective view of the exhaust elbow with three inlets and one outlet.
Figure 2:
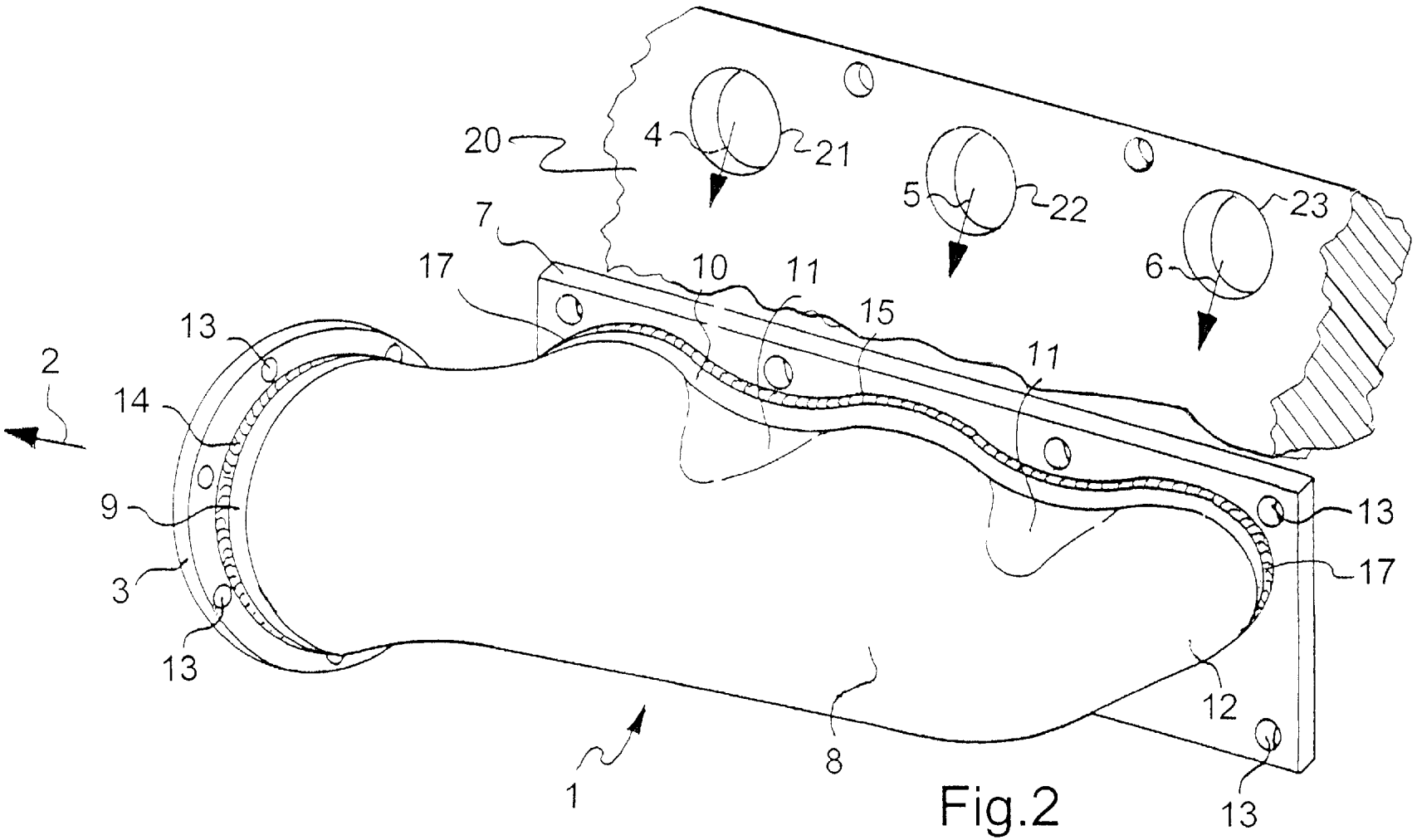
FIG. 2 is a schematic perspective view of the exhaust elbow with three inlets and one outlet Faith sheet metal hood part formed as an integral piece.

Referring to the drawings in particular, an exhaust elbow 1 comprises a single exhaust outlet 2 with an outlet mounting flange 3 and three exhaust inlets 4, 5, 6 with an inlet mounting flange 7 for fastening on the engine block 20 of a motor vehicle. The exhaust inlets into the mounting flange 3 coincide with the cylinder outlet openings 21, 22 and 23 of the engine block 20.

The exhaust gas guiding of the exhaust elbow 1 between the inlet mounting flange 7 and the outlet mounting flange 3 is formed by a single-walled sheet metal hood 8 forming a collection line, wherein the sheet metal hood 8 surrounds all exhaust inlets 4, 5, 6 together. This sheet metal hood 8, namely the peripheral edge 17 of the sheet metal hood 8 surrounds plural cylinder outlet openings (e.g. cylinder outlet openings 21, 22, and 23) of the motor vehicle engine block 20.

The sheet metal hood 8 also has an enveloping radial flange surrounding all exhaust inlets or a common enveloping radial expansion 10 on the side of the exhaust inlets 4, 5, 6, which said flange or expansion is likewise firmly connected to the inlet mounting flange 7 in a gastight manner by welding 15, preferably by laser welding.

The sheet metal hood 8 contains shape-stabilizing indentations 11 in the area between the exhaust inlets 4, 5, 6 at the top and at the bottom according to the drawing.

The sheet metal may have a one-piece design.

In the exemplary embodiment shown in the drawing, the sheet metal hood 8 is formed by two half shells, which are connected to one another by means of a congruent connection flange 12, which is a sheet metal rebate bent over once.

The two half shells are mirror symmetrical in relation to the connection plane of the connection flanges 12.

The inlet mounting flange 7 and the outlet mounting flange 3 are fastening plates arranged at right angles to one another, as in the state of the art. The mounting flanges have through holes 13, via which the exhaust elbow 1 can be fastened to the engine block by means of studs and to down stream exhaust components.

While specific embodiments of the invention have been shown and described in detail to illustrate the application of the principles of the invention, it will be understood that the invention may be embodied otherwise without departing from such principles.

What is claimed is:

1. An exhaust elbow for mounting to a motor vehicle engine block with a plurality of cylinder outlet openings, said exhaust elbow comprising:

an outlet mounting flange defining a single exhaust gas outlet;

an inlet mounting flange for fastening on the motor vehicle engine block;

an exhaust gas guiding duct between said inlet mounting flange and said outlet mounting flange, said guiding duct including a single-walled sheet metal hood defining a single collection line in fluid communication with each of the plurality of cylinder outlet openings and with the single exhaust gas outlet, said single collection line extending uninterrupted between said outlet mounting flange and said inlet mounting flange and being the only collection line extending between said outlet mounting flange and said inlet mounting flange.

2. An exhaust elbow in accordance with claim 1, wherein said single-walled sheet metal hood defining a single collection line has an exhaust gas inlet side peripheral edge connected to said inlet mounting flange in a gastight manner with said connection at said peripheral edge forming the sole connection between said single-walled sheet metal hood and said inlet mounting flange.

3. An exhaust elbow in accordance with claim 1, wherein said sheet metal hood has a radial flange closed on a circumference or a radial expansion on a side of said exhaust outlet, said radial flange or said radial expansion being firmly connected to said outlet mounting flange in a gastight manner.

4. An exhaust elbow in accordance with claim 2, wherein said sheet metal hood peripheral edge has a enveloping radial flange surrounding of the plural motor vehicle engine block cylinder outlet openings or a common enveloping radial expansion surrounding of the plural motor vehicle engine block cylinder outlet openings.

5. An exhaust elbow and motor vehicle engine block combination, comprising:

an engine block with a plurality of cylinder outlet openings; and an exhaust elbow with an outlet mounting flange defining a single exhaust gas outlet, an inlet mounting flange for fastening on the motor vehicle engine block and an exhaust gas guiding duct between said inlet mounting flange and said outlet mounting flange, said guiding duct including a single-walled sheet metal hood defining a single collection line in fluid communication with each of the plurality of cylinder outlet openings and with the single exhaust gas outlet, said single collection line extending uninterrupted between said outlet mounting flange and said inlet mounting flange, said single-walled sheet metal hood having an exhaust gas inlet side peripheral edge connected to said inlet mounting flange in a gastight manner with said connection at said peripheral edge forming the sole connection between said single-walled sheet metal hood and said inlet mounting flange, said peripheral edge surrounding said plurality of cylinder outlet openings of said engine block.

6. An exhaust elbow in accordance with claim 5, wherein said sheet metal hood has a radial flange closed on a circumference or a radial expansion on a side of said exhaust outlet, said radial flange or said radial expansion being firmly connected to said outlet mounting flange in a gastight manner.

7. An exhaust elbow in accordance with claim 5, wherein said sheet metal hood peripheral edge has a enveloping radial flange surrounding of the plural motor vehicle engine block cylinder outlet openings or a common enveloping radial expansion surrounding of the plural motor vehicle engine block cylinder outlet openings.

* * * * *